US006347786B1

(12) United States Patent
Lai

(10) Patent No.: US 6,347,786 B1
(45) Date of Patent: Feb. 19, 2002

(54) HYDRAULIC JACK LIFTING MECHANISM

(75) Inventor: Yen-Chun Lai, Chia Yi (TW)

(73) Assignee: Shinn Fu Corporation, Tao Yuan (TW)

( * ) Notice: Subject to any disclaimer, the term of this patent is extended or adjusted under 35 U.S.C. 154(b) by 0 days.

(21) Appl. No.: 09/766,620

(22) Filed: Jan. 23, 2001

(51) Int. Cl.[7] ..... B66F 3/24

(52) U.S. Cl. ..... 254/93 H; 254/89 H; 254/93 R; 254/2 B

(58) Field of Search ..... 259/89 H, 93 H, 259/93 R, 8 B, 2 B

(56) References Cited

U.S. PATENT DOCUMENTS 3,890,684 A * 6/1975 Tallman ..... 254/93 H
4,703,916 A * 11/1987 Hung ..... 254/93 H
5,499,655 A * 3/1996 Hung ..... 254/93 H
5,542,252 A * 8/1996 Hung ..... 254/93 H

* cited by examiner

*Primary Examiner*—Derris H. Banks
*Assistant Examiner*—Lee Wilson
(74) *Attorney, Agent, or Firm*—Varndell & Varndell, PLLC

(57) ABSTRACT

A hydraulic jack lifting mechanism includes a valve seat coupled to a cylinder and an inner tube in the cylinder, a piston pump, the piston having a big piston and a small piston respectively aimed at a high-pressure fluid hole and a low-pressure fluid hole in the valve seat, a return fluid control pin, a pressure regulating valve, an one-way ball valve unit, which controls one-way flowing direction of the hydraulic fluid to extend a lifting ramp out of the inner tube to lift the load, and a return fluid valve. When lifting a heavy load, high pressure in the inner tube forces the return fluid control pin to open the steel ball of the pressure regulating valve, for enabling the internal hydraulic fluid of the big piston to flow back to the cylinder and the internal hydraulic fluid of the small piston to be pumped into the inner tube, so as to lift the load with less effort.

2 Claims, 9 Drawing Sheets

HYDRAULIC JACK LIFTING MECHANISM

BACKGROUND OF THE INVENTION

1. Field of the Invention

The present invention relates to a hydraulic jack and, more specifically, to a lifting mechanism for hydraulic jack, in which, when lifting a heavy load, high pressure in the inner tube forces the return fluid control pin to open the steel ball of the pressure regulating valve, for enabling the internal hydraulic fluid of the big piston to flow back to the cylinder and the internal hydraulic fluid of the small piston to be pumped into the inner tube, so as to lift the load with less effort.

2. Description of the Prior Art

Regular hydraulic jacks commonly use a piston pump to such and deliver a hydraulic fluid, causing the hydraulic fluid to move a lifting ramp so as to lift the load. A piston pump for this purpose has a single piston, which provides a constant pressure to deliver the hydraulic fluid when reciprocated. Therefore, the user wastes much effort to lift the lifting ramp to the bottom side of the load to be lifted. There is known a two-step hydraulic jack with a piston pump of double-piston design. This double-piston design enables the user to lift the load more efficiently. Before touching the load, the big and small pistons of the double-piston design piston pump are synchronously reciprocated to extend the lifting ramp quickly. After reaching the load, the small piston is reciprocated to pump the hydraulic fluid to force the lifting ramp outwards, and to further lift the load at a relatively lower speed.

According to conventional stepless hydraulic jacks of double-piston design, the maximum operating force is at the status when the lifting ramp receives 100% of the set pressure. Normally, the weight of the load is below 40% of the set pressure. Therefore, it is easy to lift the load of which the weight is below the set pressure. When the weight of the load is below 40% of the set pressure, the big and small pistons of the piston pump can be synchronously operated to extend the lifting ramp and to further lift the load with less effort. In a two-step lifting type hydraulic jack, the lifting ramp can be quickly extended out when receives no pressure. However, when the lifting ramp receives a pressure (for example, 10% of the set pressure), the internal hydraulic fluid of the big piston must be forced to open the steel ball of the pressure regulating valve, for enabling the internal hydraulic fluid of the big piston to flow back to the cylinder, leaving the internal hydraulic fluid of the small piston to be forced into the inner tube to extend out the lifting ramp and to further lift the load. In this case, the user must employ much effort to provide a lifting pressure equal to 100% of the set pressure plus 10% of the set pressure to overcome the pressure received by the lifting ramp. Therefore, the user must give employ much effort to lift the load. When a two-step lifting type hydraulic jack is used to lift the load of which the weight surpasses 40% of the set pressure, the user must employ much more effort to provide a lifting pressure equal to 100% of the set pressure plus 40% of the set pressure to overcome the pressure received by the lifting ramp. This lifting pressure demand is beyond the operable range of the hydraulic jack. In order to prevent the occurrence of this problem, rapid lifting mode can be operated only when the lifting ramp receives no pressure or a small amount of pressure.

SUMMARY OF THE INVENTION

The present invention has been accomplished under the circumstances in view. According to the present invention, when the lifting ramp receives a pressure over a predetermined value, the internal hydraulic fluid of the inner tube immediately forces a return fluid control pin to open the steel ball of the pressure regulating valve, for enabling the hydraulic fluid to flow back from the big piston of the piston pump to the casing. Therefore, less effort is needed to lift the load. The hydraulic jack lifting mechanism according to the present invention comprises a valve seat coupled to a cylinder and an inner tube in the cylinder, a piston pump, the piston having a big piston and a small piston respectively aimed at a high-pressure fluid hole and a low-pressure fluid hole in the valve seat, a return fluid control pin, a pressure regulating valve, an one-way ball valve unit, which controls one-way flowing direction of the hydraulic fluid to extend a lifting ramp out of the inner tube to lift the load, and a return fluid valve. When lifting a heavy load, high pressure in the inner tube forces the return fluid control pin to open the steel ball of the pressure regulating valve, for enabling the internal hydraulic fluid of the big piston to flow back to the cylinder and the internal hydraulic fluid of the small piston to be pumped into the inner tube, so as to lift the load with less effort.

DETAILED DESCRIPTION OF THE PREFERRED EMBODIMENT

Figure 1:
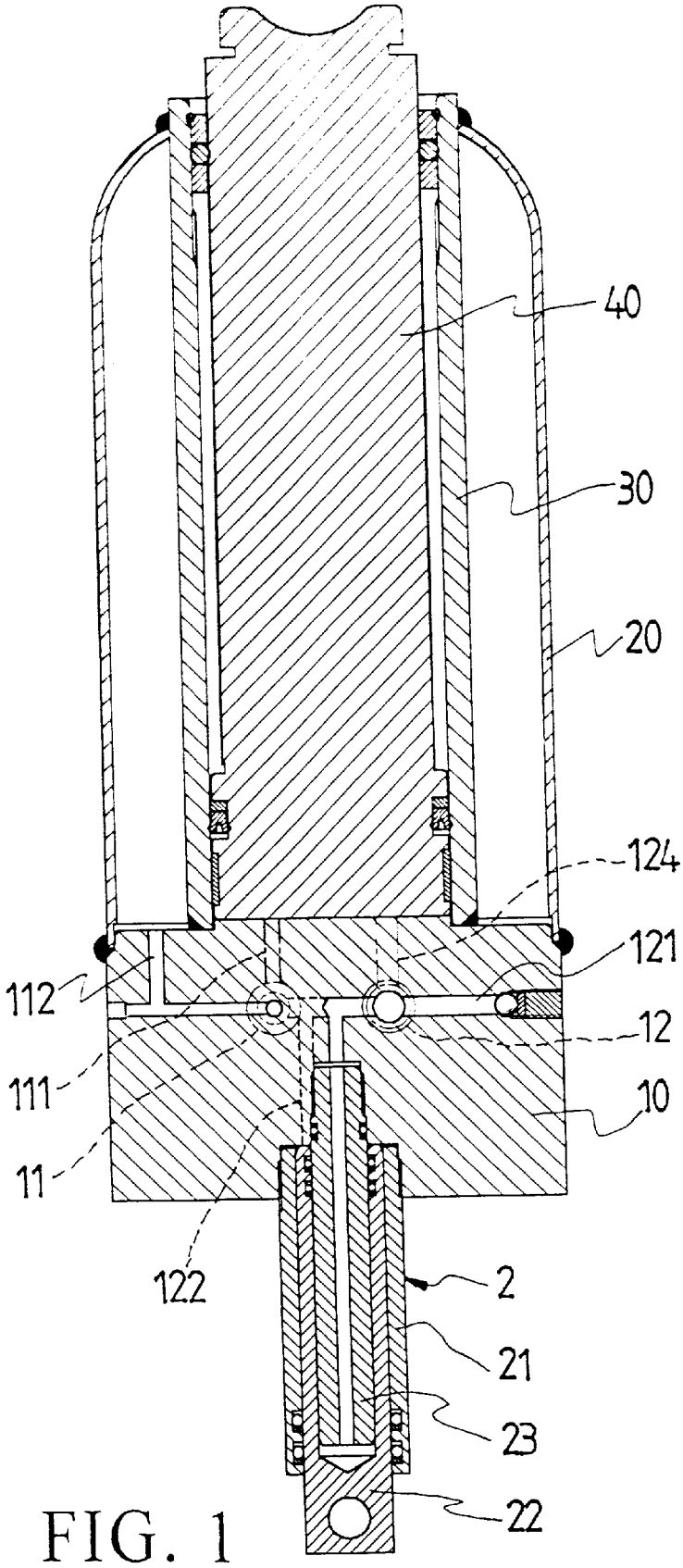
FIG. 1 is a side view of the lifting mechanism for hydraulic jack according to the present invention.
Figure 2:
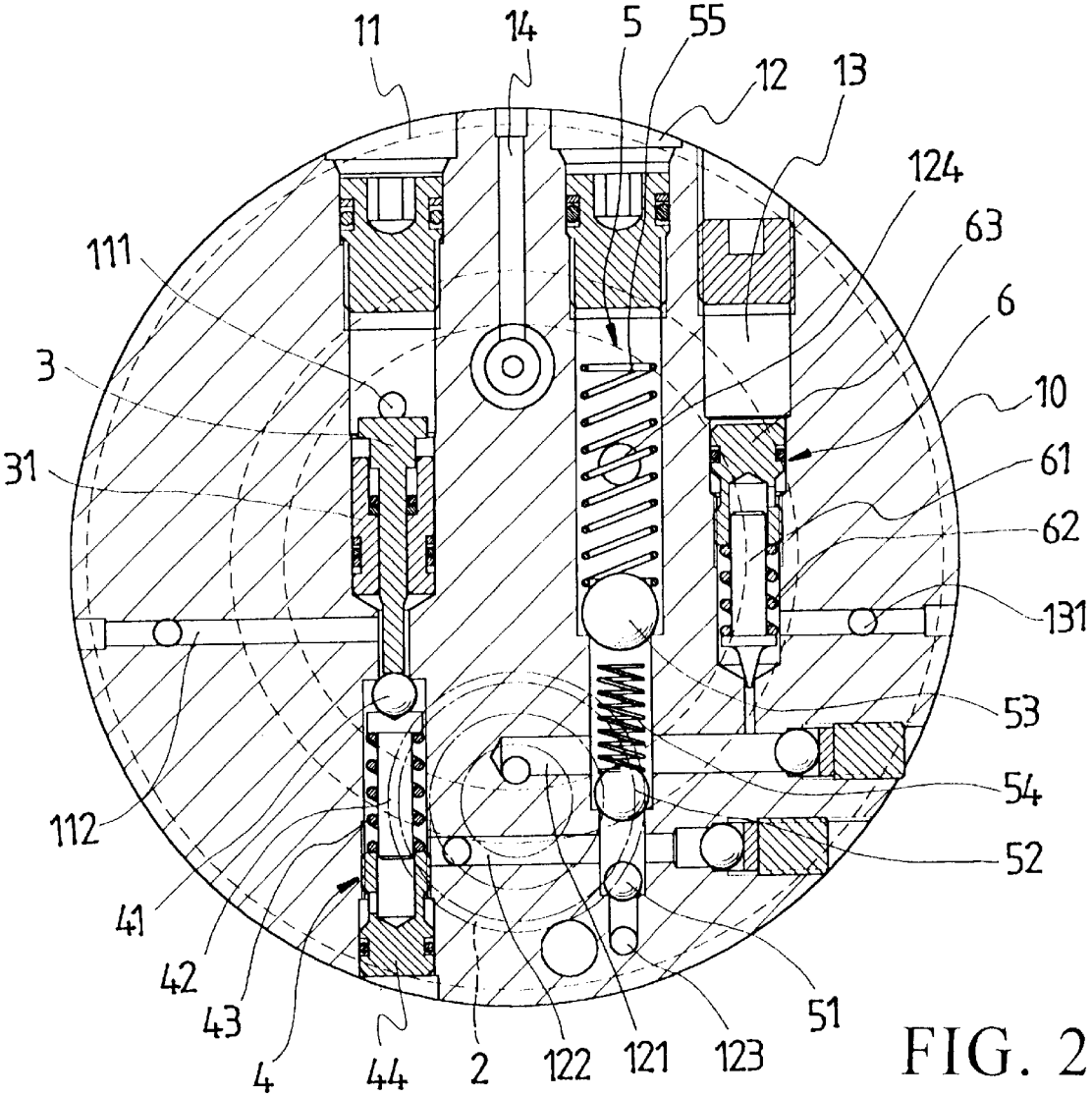
FIG. 2 is an end view in section of the lifting mechanism according to the present invention.

Referring to FIGS. 1 and 2, a lifting mechanism for hydraulic jack in accordance with the present invention is generally comprised of a valve seat and pump assembly, which is comprised of a valve seat 10, a piston pump 2, a return fluid control pin 3, a pressure regulating valve 4, an one-way ball valve unit 5, a safety valve 6, and a return fluid valve 7, a cylinder 20, an inner tube 30, and a lifting ramp 40. The cylinder 20 is coupled to one side of the valve seat 10. The inner tube 30 is provided inside the cylinder 20 and coupled to the valve seat 10. The lifting ramp 40 is mounted in the inner tube 30. The cylinder 20 is filled with a hydraulic fluid. The valve seat and pump assembly controls the input of the hydraulic fluid into the inner tube 30 to move the lifting ramp 40, so as to further lift the load. The valve seat and pump assembly comprises The valve seat 10 (see FIG. 2) is a cylindrical member comprising a radially extended first valve hole 11 adapted to receive the pressure regulating valve 4, a forward fluid hole 111 extended from an upper part of the first valve hole 11 to the inner tube 30, a return fluid hole 112 extended from a lower part of the valve hole 11 to the inside space of the cylinder 20 beyond the inner tube 30, a second valve hole 12 disposed at one side of the first valve hole 11 and adapted to receive the ball valve 5, a low-pressure fluid hole 121 extended from the second valve hole 12, a high-pressure fluid hole 122 connected between the second valve hole 12 and a lower part of the first valve hole 11, a fluid suction hole 123 connected between the bottom end of the second valve hole 12 and the inside space of the cylinder 20 beyond the inner tube 30, a fluid outlet 124 connected between the second valve hole and the inner tube 30, a third valve hole 13 disposed at one side o the second valve hole 12 opposite to the first valve hole 11 and having a bottom end connected to the low-pressure fluid hole 121, a relief hole 131 connected between the third valve hole 13 and the inside space of the cylinder 20 outside the inner tube 30, a fourth valve hole 14 extended to the front side and disposed in communication with the inside space of the cylinder 20 and the inside space of the inner tube 30.

The piston pump 2, as shown in FIG. 1, is comprised of a casing 21, a big piston 22, and a small piston 23. The big piston 22 is a tubular member axially slidably mounted in the casing 21, having one end opened and the other closed. The small piston 23 is a cylindrical member axially slidably inserted into the big piston 22, having an axial through hole 231. The casing 21 of the piston pump 2 is coupled to the front side of the valve seat 10, keeping the big piston 22 aimed at the entrance of the high-pressure fluid hole 122 and the small piston 23 aimed at the entrance of the low-pressure fluid hole 121.

The return fluid control pin 3, as shown in FIG. 2, is a stepped cylinder peripherally mounted in the first valve hole 11 and peripherally sealed with a seal ring 31. When installed, the top end of the return fluid control pin 3 is disposed at the bottom end of the forward fluid hole 111.

The pressure regulating valve 4, as shown in FIG. 2, is comprised of a steel ball 41, a support rod 42, a compression spring 43, and a screw cap 44. The steel ball 41, the support rod 42, the compression spring 43, and the screw cap 44 are inserted in proper order into the first valve hole 11 of the valve seat 10 from the bottom side. The screw cap 44 seals the bottom end of the first valve hole 11. When installed the screw cap 44 can be rotated forwards or backwards in the first valve hole 11 to adjust the spring power of the compression spring 43 to the support rod 42 and the steel ball 41. The steel ball 41 is forced by the support rod 42 against the return fluid control pin 3 to close the first valve hole 11, preventing the hydraulic fluid to flow from the return fluid hole 112 to the cylinder 20.

The one-way ball valve unit 5, as shown in FIG. 2, is comprised of steel balls 51, 52 and 53, and compression springs 54 and 55. The first steel ball 51 is inserted into the bottom end of the second valve hole 12 of the valve seat 10 to stop the passage between the fluid suction hole 123 and the high-pressure fluid hole 122 in one direction. The second steel ball 52 is inserted into the second valve hole 12 and supported on the first compression spring 54 to close the passage from the high-pressure fluid hole 122 to the fluid outlet 124. The third steel ball 53 is inserted into the second valve hole 12 and supported on the second compression spring 55 to close the passage from the low-pressure fluid hole 121 to the fluid outlet 124. By means of the aforesaid arrangement, the steel balls 51, 52 and 53 normally close the second valve hole 12 to prevent reverse flow of the hydraulic fluid from the fluid outlet 124 to the low-pressure fluid hole 121, the high-pressure fluid hole 122, or the fluid suction hole 123.

The safety valve 6, as shown in FIG. 2, comprises a push pin 61, a compression spring 62, and a cap 63. The push pin 61 is forced by the compression spring 62 to close the bottom end of the third valve hole 13.

Figure 3:
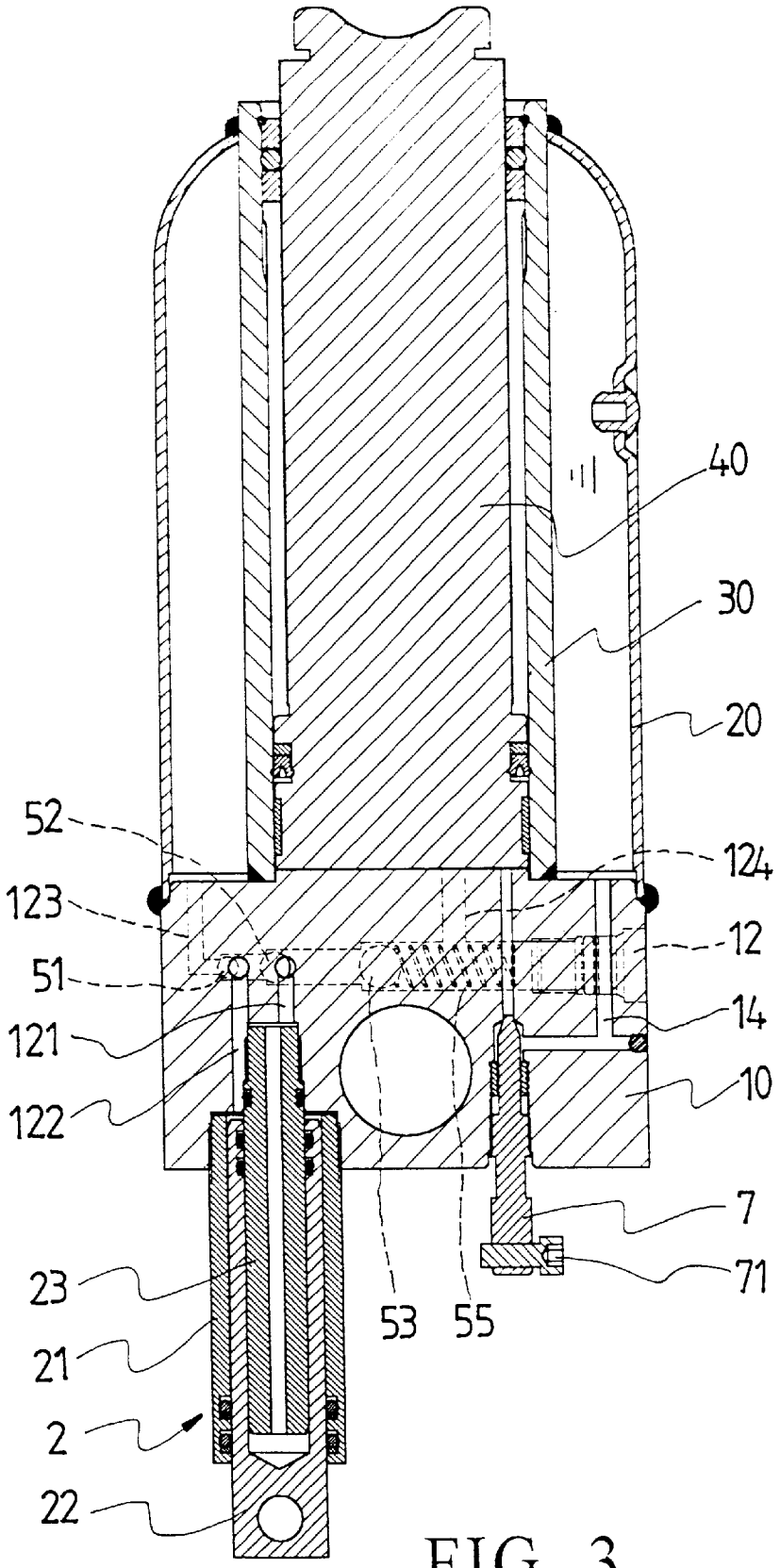
FIG. 3 is a top view in section of the lifting mechanism according to the present invention.

The return fluid valve 7, as shown in FIG. 3, is shaped like a cylindrical rod, having a screw bolt 71 transversely mounted in the rear end thereof. The front end of the return fluid valve 7 is inserted into the fourth valve hole 14 to control the fluid passage from the fourth valve hole 14 to the cylinder 20.

The valve seat 10, the piston pump 2, the return fluid control pin 3, the pressure regulating valve 4, the one-way ball valve unit 5, the safety valve 6 and the return fluid valve 7 form the structure of the present invention. When starting the piston pump 2 to pump the hydraulic fluid from the cylinder 20 into the inner tube 30, the lifting ramp 40 is extended out to lift the load.

Figure 4:
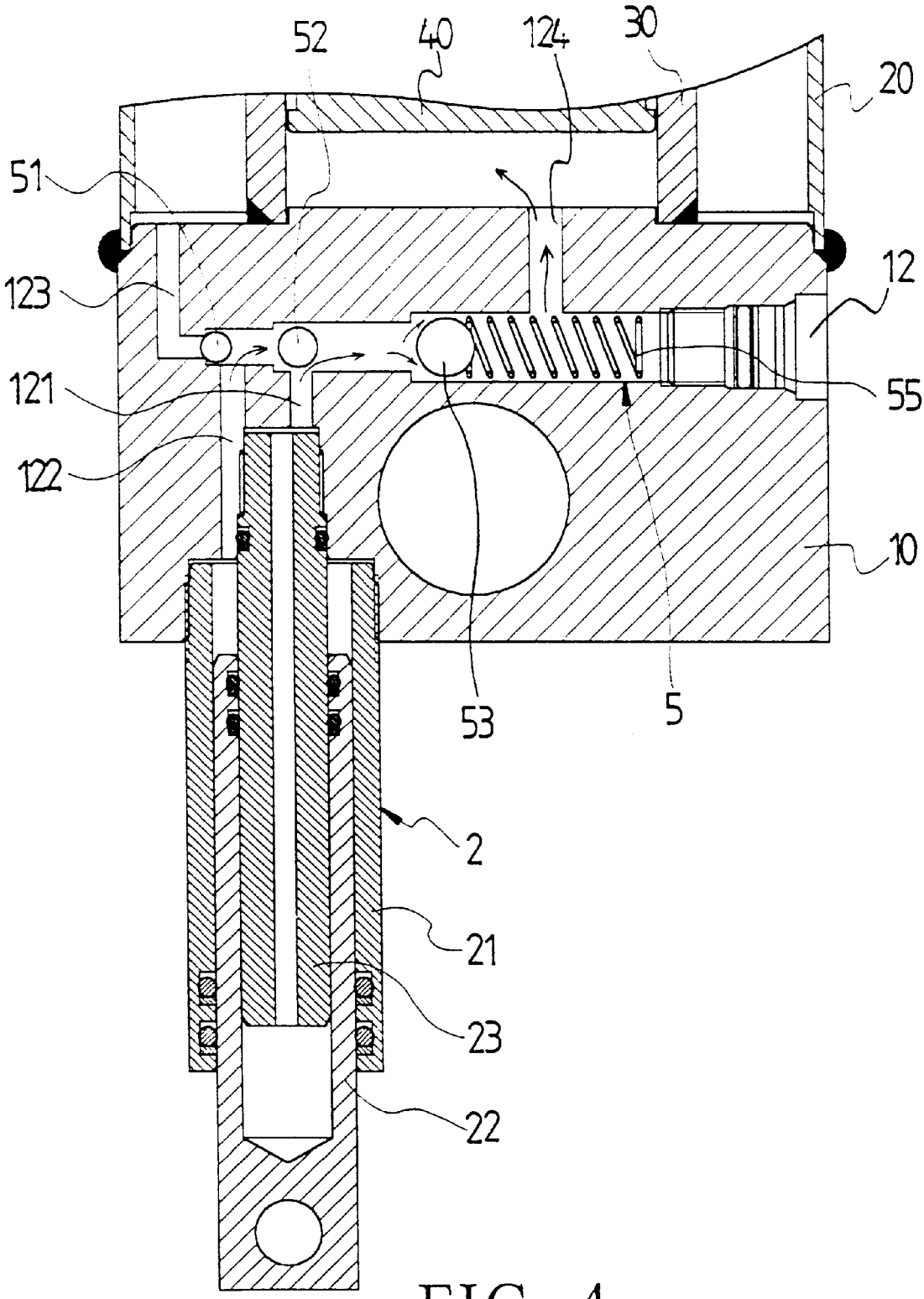
FIG. 4 is a sectional view of a part of the present invention, showing the lifting stroke of the lifting mechanism.
Figure 5:
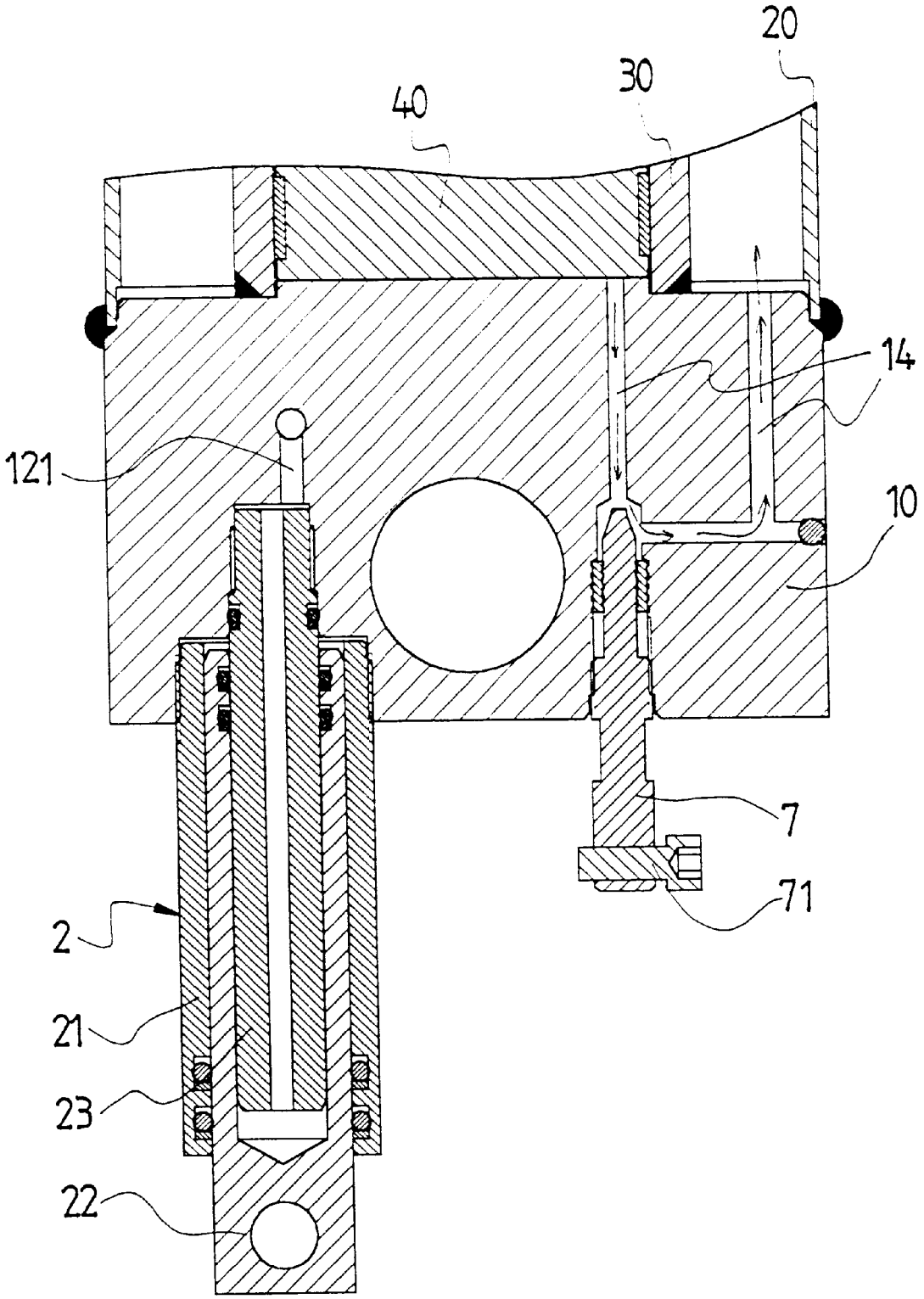
FIG. 5 is a sectional view of a part of the present invention, showing the return stroke of the lifting mechanism.

When pulling out the big and small pistons 22 and 23 of the piston pump 2, a suction force is produced to draw the hydraulic fluid to open the first steel ball 51 of the one-way ball valve unit 5 from the fluid return hole 123, so that the hydraulic fluid passes through the high-pressure fluid hole 122 to the inside of the piston pump 2. After the piston pump 2 has been filled up with the hydraulic fluid, the user can then push the pistons 22 and 23 back into the piston pump 2 to force the hydraulic fluid to flow through the high-pressure fluid hole 122 and the low-pressure fluid hole 121 into the second valve hole 12 to further push open the second and third steel balls 52 and 52 of the one-way ball valve unit 5, and then to flow through the fluid outlet 124 into the inner tube 30 to extend out the lifting ramp 40 to lift the load (see FIG. 4). When lowering the lifting ramp 40, the user needs only to pull out the return fluid valve 7, enabling the hydraulic fluid to be forced by the gravity of the lifting ramp 40 or the load to flow back to the fourth valve hole 14 and the cylinder 20, and thus the lifting ramp 40 is lowered (see FIG. 5).

Figure 6:
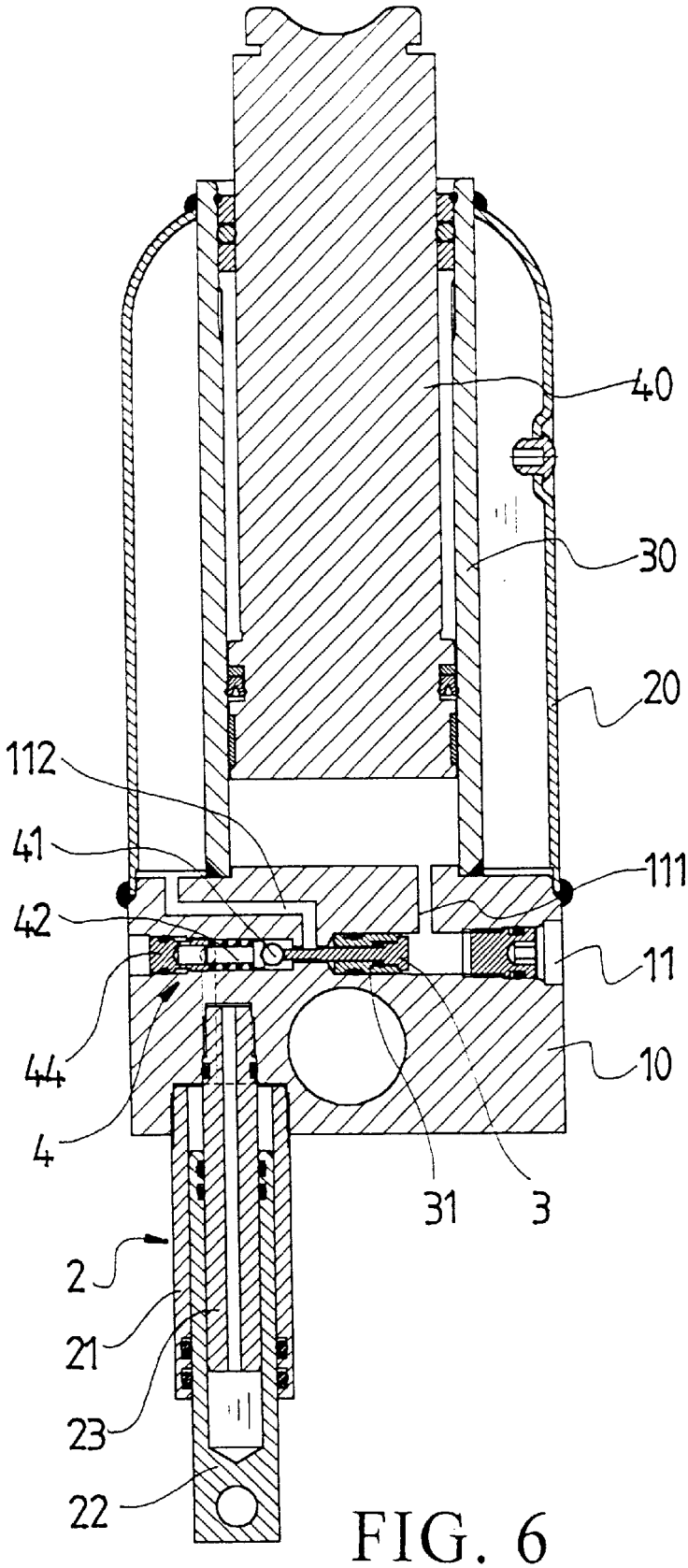
FIG. 6 is a sectional view of the present invention, showing the return stroke of the piston pump.

If the weight of the load is within 40% of the set pressure, the pistons 22 and 23 of the piston pump 2 can be synchronously operated to pump the hydraulic fluid into the inner tube 30, causing the lifting ramp 40 to rapidly lift the load. At this stage, the user uses 100% of power to lift the load of weight within 40% of the set pressure. Therefore, less effort is needed to lift the load. If the weight of the load surpasses 40% of the set pressure, the hydraulic fluid is forced by pressure to flow from the inner tube 30 through the forward fluid hole 111 to the first valve hole 11 to further force the return fluid control pin 3 to open the steel ball 41 of the pressure regulating valve 4 (see FIG. 6). When the user continuously reciprocating the big piston 22 of the piston pump 2 at this time, the hydraulic fluid is pumped from the high-pressure fluid hole 122 into the first valve hole 11 and then from the return fluid hole 112 to the cylinder 20, leaving the small piston 23 to pump the hydraulic fluid into the inner tube. Thus, an efficient low-speed, high-weight lifting mode is achieved. Because the pressure of the hydraulic fluid in the inner tube 30 is used to move the return fluid control pin 3 and the steel ball 41 of the pressure regulating valve 4 for enabling the hydraulic fluid to flow back from the big piston 22 of the piston pump 2 to the cylinder 20, the operation of the present invention requires less effort.

Figure 7:
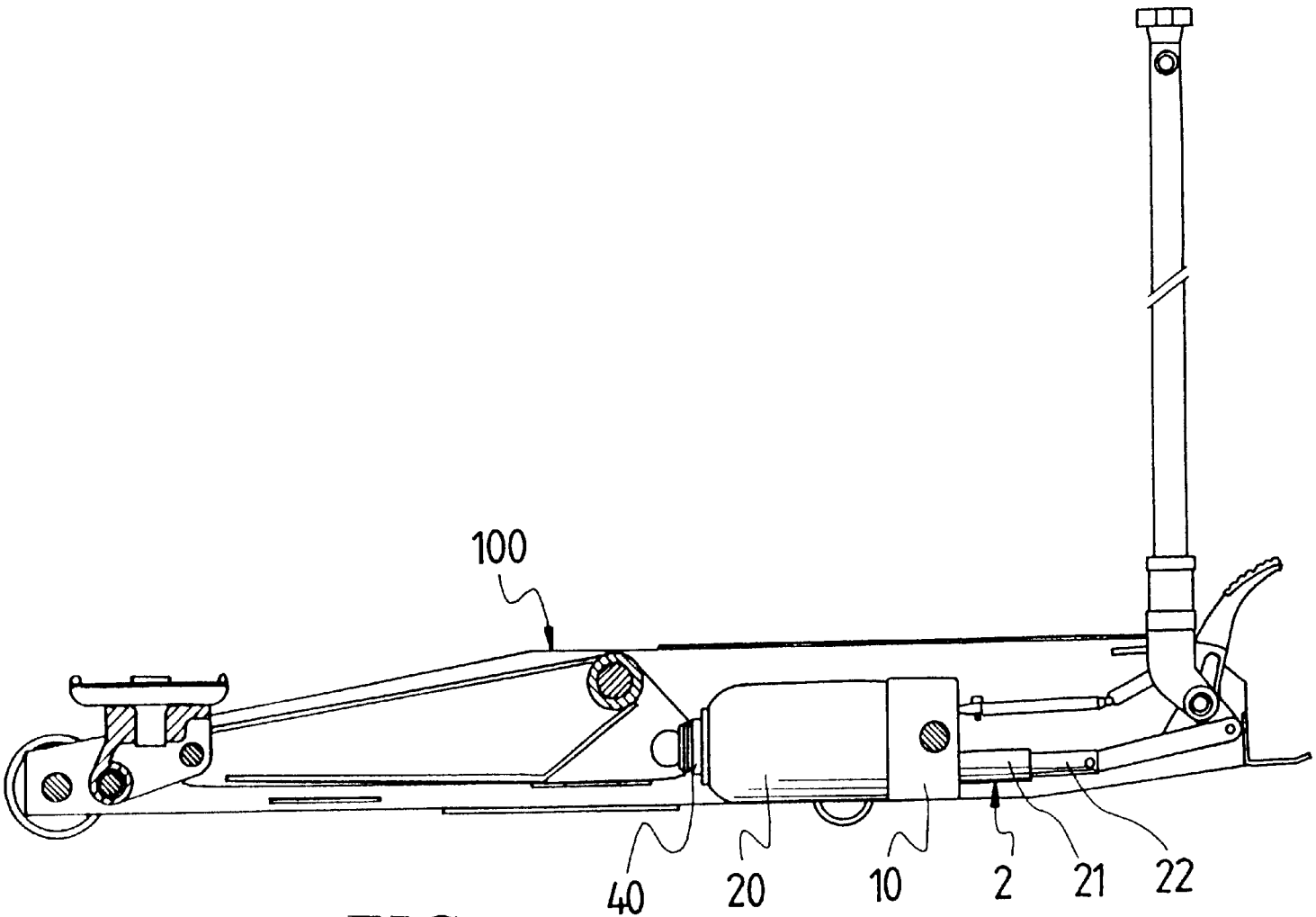
FIG. 7 shows a horizontal hydraulic jack constructed according to the present invention.
Figure 9:
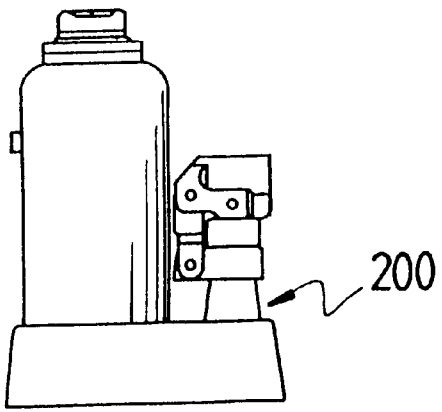
FIG. 9 shows another vertical hydraulic jack constructed according to the present invention.
Figure 8:
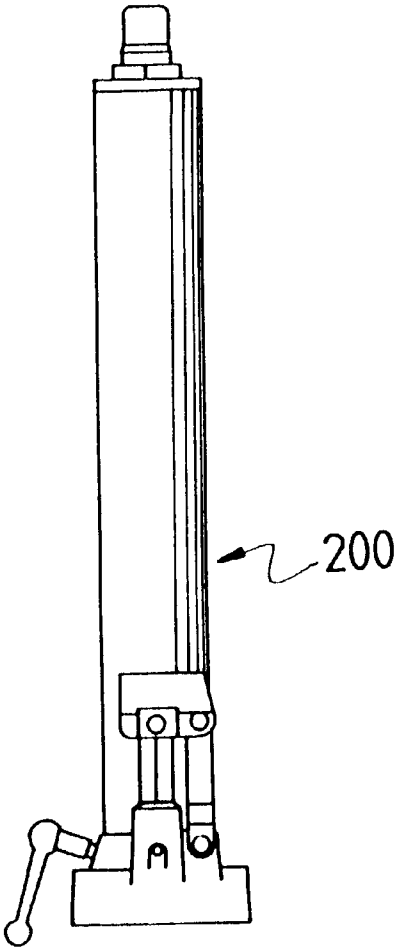
FIG. 8 shows a vertical hydraulic jack constructed according to the present invention.
Figure 10:
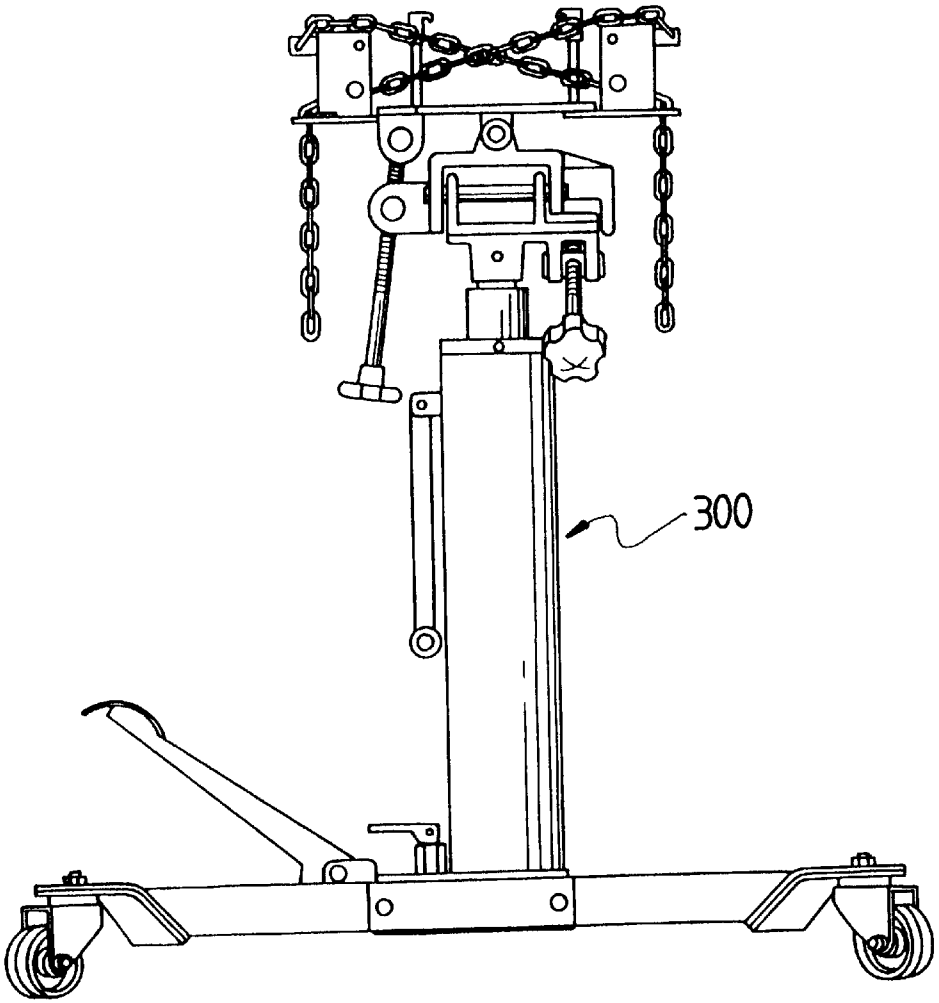
FIG. 10 shows a hydraulic car jack constructed according to the present invention.

The aforesaid structure can be used in a horizontal hydraulic jack 100 (see FIG. 7), a vertical hydraulic jack 200 (see FIGS. 8 and 9), or a hydraulic car jack 300 (see FIG. 10).

It is to be understood that the drawings are designed for purposes of illustration only, and are not intended for use as a definition of the limits and scope of the invention disclosed.

What the invention claimed is:

1. A hydraulic jack lifting mechanism comprising a valve seat and piston pump, a cylinder coupled to said valve seat and piston pump and filled up with a hydraulic fluid, an inner tube provided inside said cylinder and coupled to said valve seat and pump assembly, said valve seat and pump assembly comprising:

said valve seat comprising a radially extended first valve hole, a forward fluid hole extended from an upper part of said first valve hole to said inner tube, a return fluid hole extended from a lower part of said first valve hole to said cylinder, a second valve hole, a low-pressure fluid hole extended from said second valve hole, a high-pressure fluid hole connected between said second valve hole and a lower part of said first valve hole, a fluid suction hole connected between said second valve hole and said cylinder, a fluid outlet connected between said second valve hole and said inner tube, a third valve hole connected to said low-pressure fluid hole, a relief hole connected between said third valve hole and said cylinder, a fourth valve hole disposed in communication with said cylinder and said inner tube;

said piston pump comprising a casing coupled to coupled to the front side of the valve seat, a big piston mounted said casing and coupled to said valve seat and aimed at said high-pressure fluid hole, and a small piston mounted in said big piston and aimed at said low-pressure fluid hole;

a return fluid control pin shaped as a stepped cylinder and movably mounted said first valve hole and peripherally sealed with a seal ring;

a pressure regulating valve mounted in said first valve hole, said pressure regulating valve comprising stopped against said return fluid control pin, a support rod stopped at the steel ball of said pressure regulating valve against said return fluid control pin, a compression spring a screw cap with threaded into said first valve hole to close a bottom end of said first valve hole, and a compression spring supported between said screw cap and said support rod;

an one-way ball valve unit mounted in said second valve hole, said one-way ball valve unit comprising a first steel ball, a second steel ball, a third steel ball, a first compression spring and a second compression spring, said first steel ball being inserted into said second valve hole to stop the passage between said fluid suction hole and said high-pressure fluid hole in one direction, said second steel ball being inserted into said second valve hole and supported on said first compression spring to close the passage from said high-pressure fluid hole to said fluid outlet, said third steel ball being inserted into said second valve hole and supported on said second compression spring to close the passage from said low-pressure fluid hole to said fluid outlet; and a return fluid valve inserted into said fourth valve hole to control the fluid passage from said fourth valve hole to said cylinder, said return fluid valve having a rear end mounted with a screw bolt disposed outside said valve seat.

2. The hydraulic jack lifting mechanism of claim 1 further comprising a safety valve mounted in said third valve hole, said safety valve comprising a cap fastened to one end of said third valve hole, a push pin, and a compression spring connected between the cap and push pin of said safety valve to force the push pin of said safety valve to close said third valve hole.

* * * * *